United States Patent [19]

Spinosa et al.

[11] Patent Number: 4,648,160

[45] Date of Patent: Mar. 10, 1987

[54] CLOSURE DEVICE FOR HIGH PRESSURE PACKAGING

[75] Inventors: Dominic J. Spinosa, Wantagh; Frank Knoll, Huntington Station, both of N.Y.

[73] Assignee: East/West Industries, Hauppauge, N.Y.

[21] Appl. No.: 726,133

[22] Filed: Apr. 23, 1985

[51] Int. Cl.[4] ..... B25B 1/08

[52] U.S. Cl. ..... 24/515; 24/30.5 R; 269/234; 269/238

[58] Field of Search ..... 24/30.5 R, 30.5 P, 515, 24/517, 564, 568, 502, 503, 505, 513; 269/153, 234, 238; 383/42, 59, 68, 81; 292/156, 161, 162

[56] References Cited

U.S. PATENT DOCUMENTS

| | | | |
|---|---|---|---|
| 638,507 | 12/1899 | Graves | 24/564 |
| 2,231,530 | 2/1941 | Edwards | 292/162 X |
| 2,500,363 | 3/1950 | Koeppel | 383/59 |
| 2,544,929 | 3/1951 | Madsen et al. | 383/59 X |
| 2,596,635 | 5/1952 | Wolfe | 24/503 |
| 2,979,763 | 4/1961 | Stubryla | 24/517 X |
| 3,086,264 | 4/1963 | Tindall | 383/68 X |
| 3,127,648 | 4/1964 | Emery | 24/16 |
| 4,183,567 | 1/1980 | Bone | 292/318 |
| 4,188,017 | 2/1980 | Pingler | 269/234 X |
| 4,263,697 | 4/1981 | Speedie | 24/305 P |
| 4,299,417 | 11/1981 | McClure | 292/320 |
| 4,306,745 | 12/1981 | Wenk | 292/378 |
| 4,424,999 | 1/1984 | Commins | 294/142 |
| 4,551,888 | 11/1985 | Beecher | 24/30.5 P |

FOREIGN PATENT DOCUMENTS

| | | | |
|---|---|---|---|
| 357510 | 8/1922 | Fed. Rep. of Germany | 24/517 |

*Primary Examiner*—Kenneth J. Dorner
*Assistant Examiner*—James R. Brittain
*Attorney, Agent, or Firm*—Hoffman, Dilworth, Barrese & Baron

[57] ABSTRACT

A closure assembly useful as a means for sealing a pressurized package which includes clamping means shiftable between an open position to receive an open portion of the pressurized package and a closed position to substantially hermetically seal the open portion of the pressurized package. The assembly also includes a retaining means coupled to the clamped means and adapted to be actuated by a force substantially independent of the force associated with the pressurized package whereupon the actuating force will maintain the clamping means in the closed position. Another part of the present closure assembly is an actuation means which is engageable with the retaining means in a manner which supplies the force enabling the retaining means to keep the clamping means in the closed position.

9 Claims, 4 Drawing Figures

CLOSURE DEVICE FOR HIGH PRESSURE PACKAGING

BACKGROUND OF THE INVENTION

The present invention relates to the art of closure devices, and, in particular, to devices which can provide a substantially air-tight seal without use of excessive amount of force.

It has been known in the art of package closure devices to provide simple independent closures which can be easily attached or installed manually or otherwise on flexible package openings with little or no effort required to control or respond to the packaging structure and peculiarities. For example, there are closure devices, such as security seals, which are applied to close bags, containers, or locks in such manner that the container or lock may only be opened by breaking the seal. These types of closures generally include a fastening head or body portion and an elongated flexible element attached thereto which has fastening elements that fit cooperatively with mating elements in the head portion. Examples of such closures are shown in U.S. Pat. Nos. 4,424,999; 4,306,745; 4,299,417; 4,263,697; 4,183,567; and 3,127,648. These devices do not provide any type of sealing characteristics. Thus, while they can be made relatively simply and are inexpensive, they are not useful for sealing packages having contents which require preservation from the environment.

In order to obtain sealed conditions, it has been known to provide a rigid opening whereby normal pressure sealing methods can be employed, e.g., welding, and application of sealing materials such as wax, etc. Known pressure sealing methods, however, require relatively expensive materials and equipment to effective proper sealing. Moreover, there is no presently known device for creating a sealing closure for a flexible package opening, which is easily applied and is disposable. Specifically in the case of a high pressure package, such as a vacuum pack or a superatmospheric pack, since the force required to establish the pressure package is high, it is usually necessary to employ a high degree of force in order to establish a sealed package.

Accordingly, it is an object of the present invention to provide a simple closure device for substantially hermetically sealing a pressure package.

It is another object of the invention to provide a closure device which can be easily locked in a sealing position with relatively little effort.

It is yet another object of the present invention to provide a closure device for substantially hermetically sealing a pressure package which can be made of inexpensive material.

Further objects of the present invention will be known to the practitioner by the description and drawings set forth herein.

SUMMARY OF THE INVENTION

By the present invention there is provided a closure assembly useful for sealing pressurized packages which includes clamping means shiftable between an open position to receive an open portion of a pressurized package and a closed position in which the clamping means substantially hermetically seals the open portion of the pressurized package. The assembly also includes retaining means coupled with the clamping means and adapted to be actuated by a force which is substantially independent of the force associated with establishing the pressurized package whereupon the actuating force will maintain the clamping means in the closed position. The assembly further includes actuation means engageable with the retaining means in a manner which supplies the force enabling the retaining means to keep the clamping means in the closed position.

In a preferred embodiment of the invention the closure assembly includes two jaw members having mating clamp portions and mating retaining portions which are hinged for rotation between the open position and the closed position so that the mating clamp portions cooperatively form the clamping means and the mating retaining means cooperatively form the activable retaining means. In this embodiment the mating clamp portions are engaged to capture the opening of the pressurized package in the closed position while the mating retaining portions fit cooperatively in the closed position to provide an engagable retention lock to receive the actuation means.

It is preferable that the mating clamp portions include surface configurations which mesh with each other when engaged in the closed position, such surface configurations including, for example, corrugated, serrated, and multiple interlocking projections. As presently known, the most preferred embodiment of the invention includes a surface which has at least one elongated serration extending transversely across the surface of the clamp portion, the peak of one serration fitting cooperatively in the depression of the at least one serration on the opposite clamp surface when the clamps are engaged in the closed position, and most preferably there are at least about two adjacent serrations on each of the clamp portion surfaces.

Also in a preferred embodiment of the present invention the mating retaining portion includes at least one interlocking finger on each of the jaw members which has an aperture therethrough. The apertures on adjacent fingers are aligned when the jaw members are in the closed position so that a continuous passage is defined through the interlocking fingers to form an engagable retention lock. In this case, the actuation means can include a tapered member sized to pass as a wedge through the continuous passage formed by the aligned aperture in the interlocking fingers whereby rotation to the open position is prevented.

Preferably each of the interlocking fingers can be an extension of a portion of the clamp, such extension including a base portion immediately adjacent the clamp portion which has sufficient thickness to provide housing for a hinge means. In this case the aperture can be open on the same side as the clamp surface of the same jaw member, such as a three-sided or C-shaped opening located at the extension of the interlocking finger.

In order to provide the mating configuration the fingers formed on the jaw members can be adjacent openings having sufficient width for the passage of one of the fingers and located on the clamp portions in alternating relationship with the fingers of the mating jaw so that the fingers face each other and base portions of the fingers overlap to provide a common axis of rotation for the jaw members. In this case, an axle means can extend through an common axis of rotation located in the base portion whereby the hinged rotation is provided.

Preferably, there can be at least three sets of interlocking fingers for insertion of three tapered members rigidly connected to each other for simultaneous movement. Removal of the wedged tapered members from the continuous passages formed by the set of interlocking fingers is quite easily accomplished with little force required.

As a result of the closure assembly of the present invention, a highly effective means for sealing a pressurized package, which can be made of a flexible material, is provided which can be actuated by relatively little force, and more importantly, by an amount of force which does not have to overcome the force associated with the pressurization of the package.

Moreover, as a result of the present invention a very simple closure means can be provided which can be constructed out of inexpensive material such as plastic that can be discarded after a single use.

Another advantage of the present invention is that it can be unlocked simply by removing the wedge actuation means from the continuous passage formed by the interlocking fingers, which requires very little effort and can be, therefore, used in conjunction with simple lightweight unlocking mechanisms such as a parachute rip pin assembly, sleeping bag cover, etc.

Also as a result of the present invention the closure assembly may be easily configured and sized to fit any type of high pressure packaging, such as a vacuum packed parachute which usually includes a web-type material.

For a better understanding of the present invention, together with other and further objects, reference is made to the following description taken in conjunction with the accompanying drawings, and its scope will be pointed out in the appended claims.

BRIEF DESCRIPTION OF THE DRAWINGS

Preferred embodiments of the invention have been chosen for purposes of illustration and description and are shown in the accompanying drawings wherein.

DETAILED DESCRIPTION OF THE INVENTION

Figure 1:
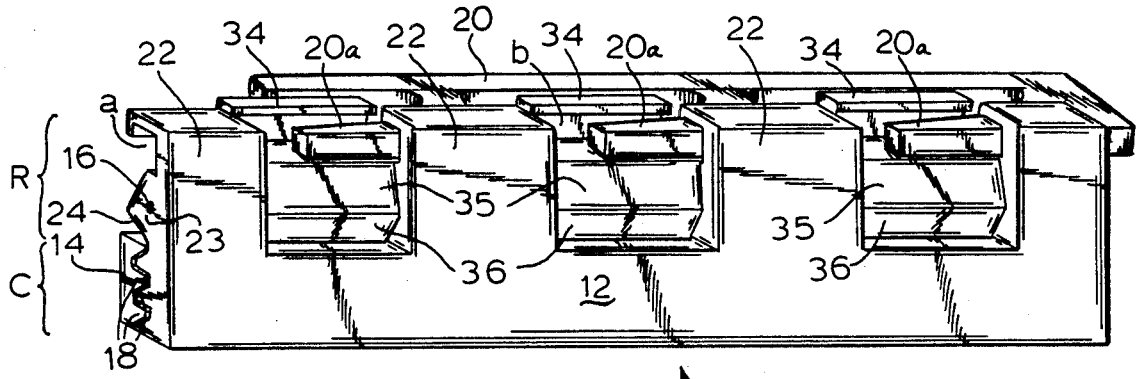
FIG. 1 is a perspective view of one embodiment of the present invention which is fully assembled in the closed position.
Figure 2:
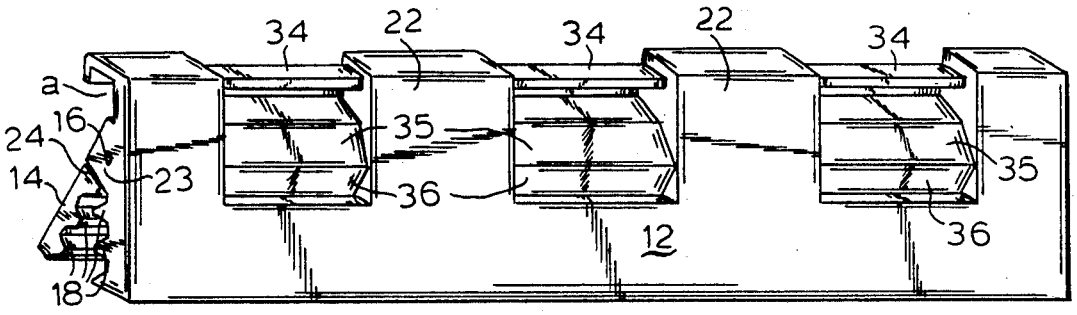
FIG. 2 is a perspective view of the same embodiment as shown in FIG. 1 which is in the open position wherein the opening of a package can be received.
Figure 3:
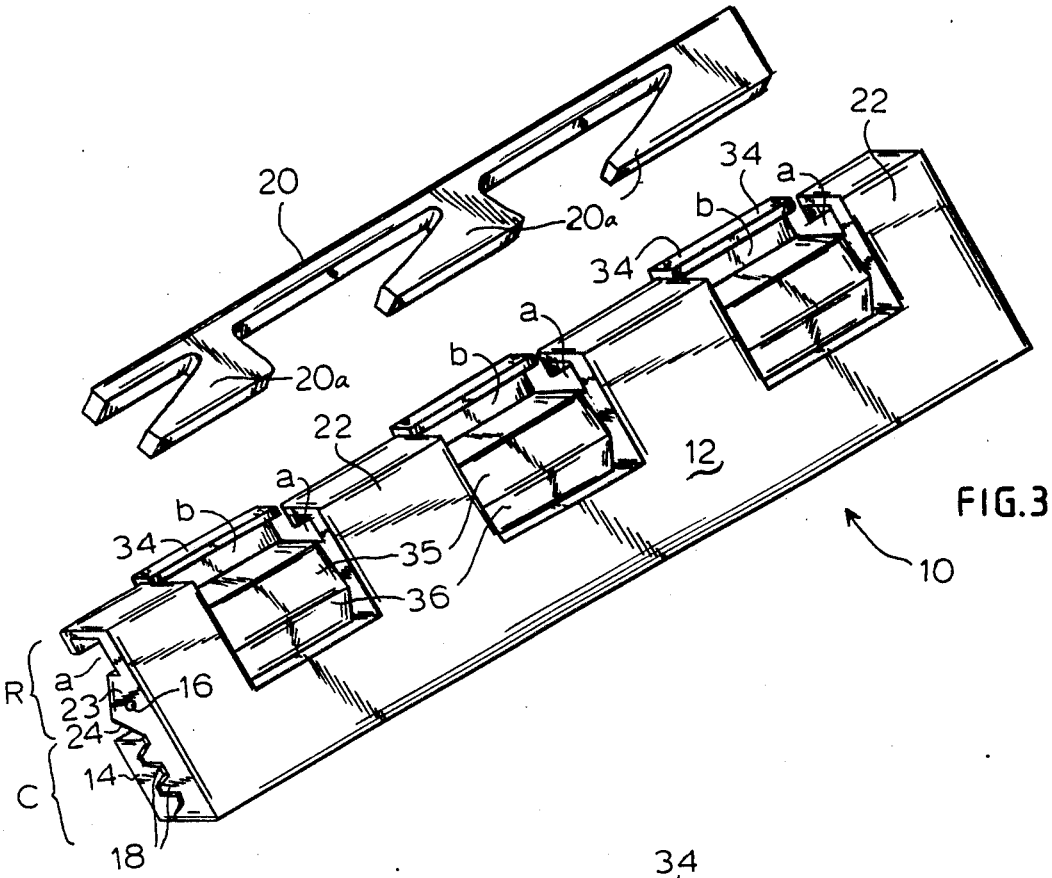
FIG. 3 is a perspective view of the embodiments shown in FIGS. 1 and 2 which is in the closed position but disassembled.
Figure 4:
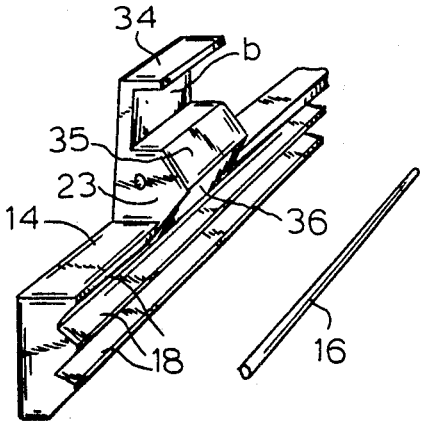
FIG. 4 is a perspective view of a section of one of the jaw members of the embodiment shown in the previous Figures.

Referring to the drawings, FIGS. 1–4 show an embodiment of the present invention in which the closure assembly 10 is in different stages of operation, e.g., FIG. 1 shows stages of the closure assembly 10 in the fully actuated closed or clamped position, while FIG. 2 depicts the open position and in FIG. 3 the assembly is closed, but not actuated.

The assembly shown in the drawings includes two jaws 12 and 14 which can be joined together in a mating relationship such that the lower portion forms a clamp, C, and the upper portion forms the retaining means, R, which can be actuated to maintain the jaws in the closed position as shown in FIGS. 1 and 3.

In the embodiment shown in the drawings the jaws 12 and 14 can be joined along any of the the common axes of rotation by an axle 16 to provide rotation between the closed position and the open position depicted in FIG. 2 in which an open portion of a pressurized package can be inserted. As a result of the design of the clamping portion, C, as well as the efficient actuation mechanism provided in the present invention, the assembly can be closed to substantially hermetically seal the open portion of a pressurized package.

Referring specifically to FIGS. 1 and 3 there can also be seen a side lock 20 which can be easily inserted into the assembly manually or otherwise to provide a force which is substantially independent of the force associated with pressurization of the package to maintain the assembly in a secure clamped position.

Referring to each jaw member in this embodiment of the invention, it can be seen that the clamp portion of each jaw is characterized by an uneven interlocking surface configuration, shown herein as a longitudinal serrations 18, which can fit cooperatively with each other to effect a sealing engagement of a flexible web opening of a package. Alternatively, the surface of the clamp portions of the jaw can be in the form of mating corrugations or other types of surface projections which fit cooperatively with the surface projections of the mating clamp portion of the other jaw whereby a web material passing therebetween would be effectively sealed together to substantially prevent passage of air or other fluid therethrough.

The upper members of the jaws shown herein can be interlocking fingers designated generally as 22 and 34, which, in this embodiment, are extensions of the clamp portion of each jaw. Each interlocking finger has a base 23, 35 which have sufficient thickness to provide a housing for a hinge member such as the axle 16. The fingers also include an apertured opening, a, b, respectively opening in the same direction as that of the clamp surface. The fingers are formed alternatively with openings so that when the assembly is in the clamped position the base portion of the fingers are allowed to move through the opposite opening, the overlap of the base portion providing common axes of rotation for the assembly. Furthermore, the apertures are aligned in the closed position to provide a continuous passage between mating fingers so that a tapered member such as keys 20*a* can be inserted as a wedge between the fingers to prevent movement in the opening direction. In the embodiment shown herein the keys 20*a* are shown as elongated rectangular wedge members, but the present invention is not considered in any way to be constrained by such showing and can include wedge shapes such as circular, pyramidal, etc. Furthermore, in accordance with the invention shown in the drawings, the thickened base portion can be provided with chamfered surfaces 24, 36 to facilitate even and unhampered movement between the open and closed position.

In operation the assembled jaws are easily rotated between the open position shown in FIG. 2 and the closed position shown in FIG. 3 so that the web opening of a pressurized package can be inserted after having effected the pressurization, whether it be a vacuum pack or providing superatmospheric pressure. The jaws are then rotated to the closed position shown in FIG. 3 while the side lock 20 is positioned with keys 20*a* aligned with continuous apertures a-b. The side lock is easily slid through the aligned apertures to provide a constant retaining force in the fully assembled position, as shown in FIG. 1. In order to open the pressurized package the side lock 20 can simply be slid in the opposite direction to remove the wedging effect of the keys 20*a*, whereby the assembly can be rotated to the open position thus freeing the opening of the pressurized package.

Thus, while there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

We claim:

1. A closure assembly for use in sealing a pressurized package comprising:

two jaw members each said jaw member having a clamping means, a retaining means, and a hinge means between said clamping means and said retaining means, said hinge means adapted to provide hinged connection oriented in a linear clamping direction around which said jaw members pivot between an open position and a closed position, said clamping means having opposed nonplanar mating surfaces for meshing with each other in conforming surface-to-surface relationship in said closed position to substantially hermetically seal an open portion of a pressurized package clamped therebetween, and each said retaining means having at least one interlocking finger transversely offset from the opposed interlocking finger to permit free movement of said fingers past each other when pivoting said jaw members between the open and closed positions, and each said finger having a slot formed linearly therethrough which aligns in the linear clamping direction with said slot in said interlocking finger of the other retaining means to define a continuous passage between said retaining means in said closed position, and actuation means for passing through said continuous passage formed between said retaining means and maintain said jaw members in said closed position.

2. The closure assembly of claim 1 wherein there are at least two said interlocking fingers on each retaining means, said at least two fingers positioned on its respective retaining means to provide sufficient space therebetween for accommodating insertion of said actuation means.

3. The closure assembly of claim 1 wherein each said hinge means comprises a body portion having an axial bore oriented in the linear clamping direction which is aligned with the axial bore of said body portion of the other jaw member when said jaw members are in mating relationship, and an axle fixed therein to provide direct rotation of said jaw members between said open and said closed position.

4. The closure assembly of claim 1 wherein said nonplanar mating surface is one of corrugated, serrated, and multiple interlocking projections.

5. The closure assembly of claim 4 wherein said surface comprises at least one elongated serration extending in the linear clamping direction, the peak of said at least one serration of one of said mating clamp surface fitting cooperatively in the depression of said at least one serration of said other clamp surface when said clamps are engaged in said closed position.

6. The closure assembly of claim 5 wherein there are two said serrations on each said surface.

7. The closure assembly of claim 1 wherein said slot is open in the same direction as said clamping means surface.

8. The closure assembly of claim 2 wherein said actuation means comprises a tapered member sized to pass as a wedge through said continuous passage whereby pivotal movement toward said open position is prevented.

9. The assembly of claim 8 wherein there are at least three sets of interlocking fingers having three substantially equal spaces therebetween, and three tapered members sized to pass through said equal spaces and rigidly connected for simultaneous insertion and removal from the three said continuous passages formed by said slots of said interlocking fingers.

* * * * *